US005397097A

United States Patent [19]

Dale

[11] Patent Number: 5,397,097

[45] Date of Patent: Mar. 14, 1995

[54] ICE CUBE TRAYS WITH INTEGRAL LIDS

[76] Inventor: Randall W. Dale, 777 Highway 62 East, Pleasant Garden, N.C. 27313

[21] Appl. No.: 164,536

[22] Filed: Dec. 10, 1993

[51] Int. Cl.[6] ..... F25C 1/24

[52] U.S. Cl. ..... 249/121; 249/81; 249/120; D15/90

[58] Field of Search ..... 249/81, 69, 119, 120, 249/121, 126, 127, 128, 129, 131, 133; D15/90

[56] References Cited

U.S. PATENT DOCUMENTS

| | | | |
|---|---|---|---|
| D. 262,355 | 12/1981 | Oakley | D9/345 |
| 986,835 | 3/1911 | Lewis | 249/81 |
| 2,418,530 | 4/1947 | Tharp | 249/81 |
| 2,434,803 | 1/1948 | Johnson et al. | 249/126 |
| 2,725,728 | 12/1955 | Downing | 249/81 |
| 3,374,982 | 3/1968 | Sallade | 249/121 |
| 3,545,717 | 12/1970 | Pietrzak et al. | 249/69 |
| 3,776,504 | 12/1973 | Wiley | 249/121 |
| 3,829,056 | 8/1974 | Baker et al. | 249/121 |
| 4,023,768 | 5/1977 | Herrera-Casasus | 249/81 |
| 4,081,122 | 3/1978 | Hobson | 249/127 |
| 4,147,324 | 4/1979 | Walter | 249/121 |
| 4,366,941 | 1/1983 | Harris | 249/120 |
| 4,887,790 | 12/1989 | Wilkinson et al. | 249/121 |

FOREIGN PATENT DOCUMENTS

| | | | |
|---|---|---|---|
| 2003551 | 8/1971 | Germany | 249/69 |
| 63-185073 | 11/1988 | Japan | 249/120 |

*Primary Examiner*—James P. Mackey
*Attorney, Agent, or Firm*—Hugh E. Smith

[57] ABSTRACT

An ice cube tray comprising a tray having an upper horizontal peripheral ledge and an upwardly extending vertical periphery terminating in an upper edge, a plurality of planar connectors in a grid pattern located in the plane of the upper ledge and a plurality of compartments extending downwardly from the connectors, each of the compartments having a lower horizontal surface parallel with, but spaced beneath the upper horizontal plane with the connectors at a depth essentially equal to the distance of the depth of the water placed in the tray and the resulting ice cubes, each of the compartments also including a plurality of generally vertically extending side walls in a rectangular configuration extending between the connectors and the lower horizontal surface.

1 Claim, 4 Drawing Sheets

ICE CUBE TRAYS WITH INTEGRAL LIDS

BACKGROUND OF THE INVENTION

1. Field of the Invention

The present invention relates to ice cube trays with integral lids and more particularly pertains to ice cube tray assemblies with trays, lids and integral hinges therebetween.

2. Description of the Prior Art

The use of ice cube trays is known in the prior art. More specifically, ice cube trays heretofore devised and utilized for the purpose of making ice cubes are known to consist basically of familiar, expected, and obvious structural configurations, notwithstanding the myriad of designs encompassed by the crowded prior art which has been developed for the fulfillment of countless objectives and requirements.

The patent literature discloses a large number of trays for freezing ice cubes. By way of example, U.S. Pat. No. 3,545,717 to Pietrzak discloses an ice cube tray and bin combination.

U.S. Pat. No. 4,366,941 to Harris discloses a plurality of ice cube trays in a stacked configuration, each tray having a separable lid.

U.S. Pat. No. 4,081,122 to Hobson discloses an ice cube tray and egg carton in combination.

Lastly, U.S. Pat. No. 262,355 to Oakley discloses a combined egg carton and ice tray.

In this respect, ice cube trays with integral lids according to the present invention substantially depart from the conventional concepts and designs of the prior art, and in doing so provides an apparatus primarily developed for the purpose of more conveniently making ice cubes.

Therefore, it can be appreciated that there exists a continuing need for new and improved ice cube trays with integral lids which can be used for more conveniently making ice cubes. In this regard, the present invention substantially fulfills this need.

SUMMARY OF THE INVENTION

In view of the foregoing disadvantages inherent in the known types of ice cube trays now present in the prior art, the present invention provides improved ice cube trays with integral lids. As such, the general purpose of the present invention, which will be described subsequently in greater detail, is to provide new and improved ice cube trays with integral lids and methods which have all the advantages of the prior art and none of the disadvantages.

To attain this, the present invention essentially comprises a new and improved ice cube tray for receiving water and for converting it to ice cubes comprising, in combination, a tray having an upper horizontal peripheral ledge and an upwardly extending vertical periphery terminating in an upper edge, a plurality of planar connectors in a grid pattern located in the plane of the upper ledge and a plurality of compartments extending downwardly from the connectors, each of the compartments having a lower horizontal surface parallel with, but spaced beneath the upper horizontal plane with the connectors at a depth essentially equal to the distance of the depth of the water placed in the tray and the resulting ice cubes, each of the compartments also including a plurality of generally vertically extending side walls in a rectangular configuration extending between the connectors and the lower horizontal surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved ice cube trays with integral lids which have all the advantages of the prior art ice cube trays and none of the disadvantages.

It is another object of the present invention to provide new and improved ice cube trays with integral lids which may be easily and efficiently manufactured and marketed.

It is a further object of the present invention to provide new and improved ice cube trays with integral lids which are of a durable and reliable construction.

An even further object of the present invention is to provide new and improved ice cube trays with integral lids which are susceptible of a low cost of manufacture with regard to both materials and labor, and which accordingly are then susceptible of low prices of sale to the consuming public, thereby making such ice cube trays with integral lids economically available to the buying public.

Still yet another object of the present invention is to provide new and improved ice cube trays with integral lids which provides in the apparatuses and methods of the prior art some of the advantages thereof, while simultaneously overcoming some of the disadvantages normally associated therewith.

Even still another object of the present invention is to more conveniently make ice cubes.

Lastly, it is an object of the present invention to provide a new and improved ice cube tray comprising a tray having an upper horizontal peripheral ledge and an upwardly extending vertical periphery terminating in an upper edge, a plurality of planar connectors in a grid pattern located in the plane of the upper ledge and a plurality of compartments extending downwardly from the connectors, each of the compartments having a lower horizontal surface parallel with, but spaced beneath the upper horizontal plane with the connectors at a depth essentially equal to the distance of the depth of the water placed in the tray and the resulting ice cubes, each of the compartments also including a plurality of generally vertically extending side walls in a rectangular configuration extending between the connectors and the lower horizontal surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
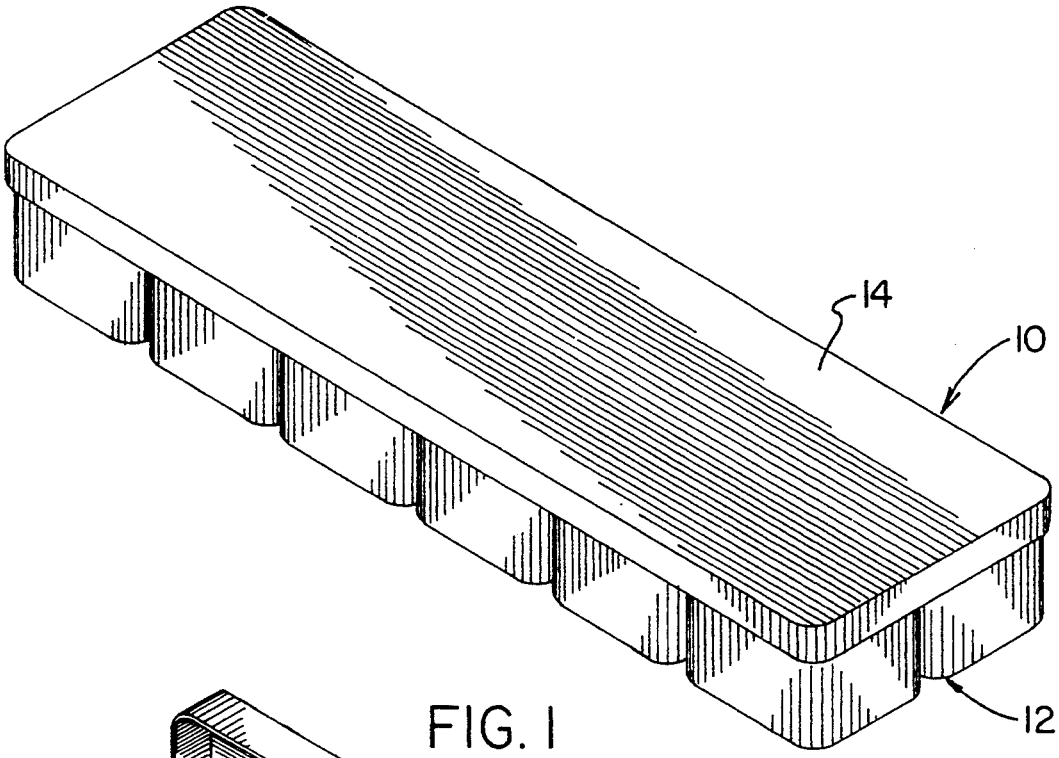
FIG. 1 is a perspective view of the preferred embodiment of the ice cube trays with integral lids constructed in accordance with the principles of the present invention.
Figure 2:
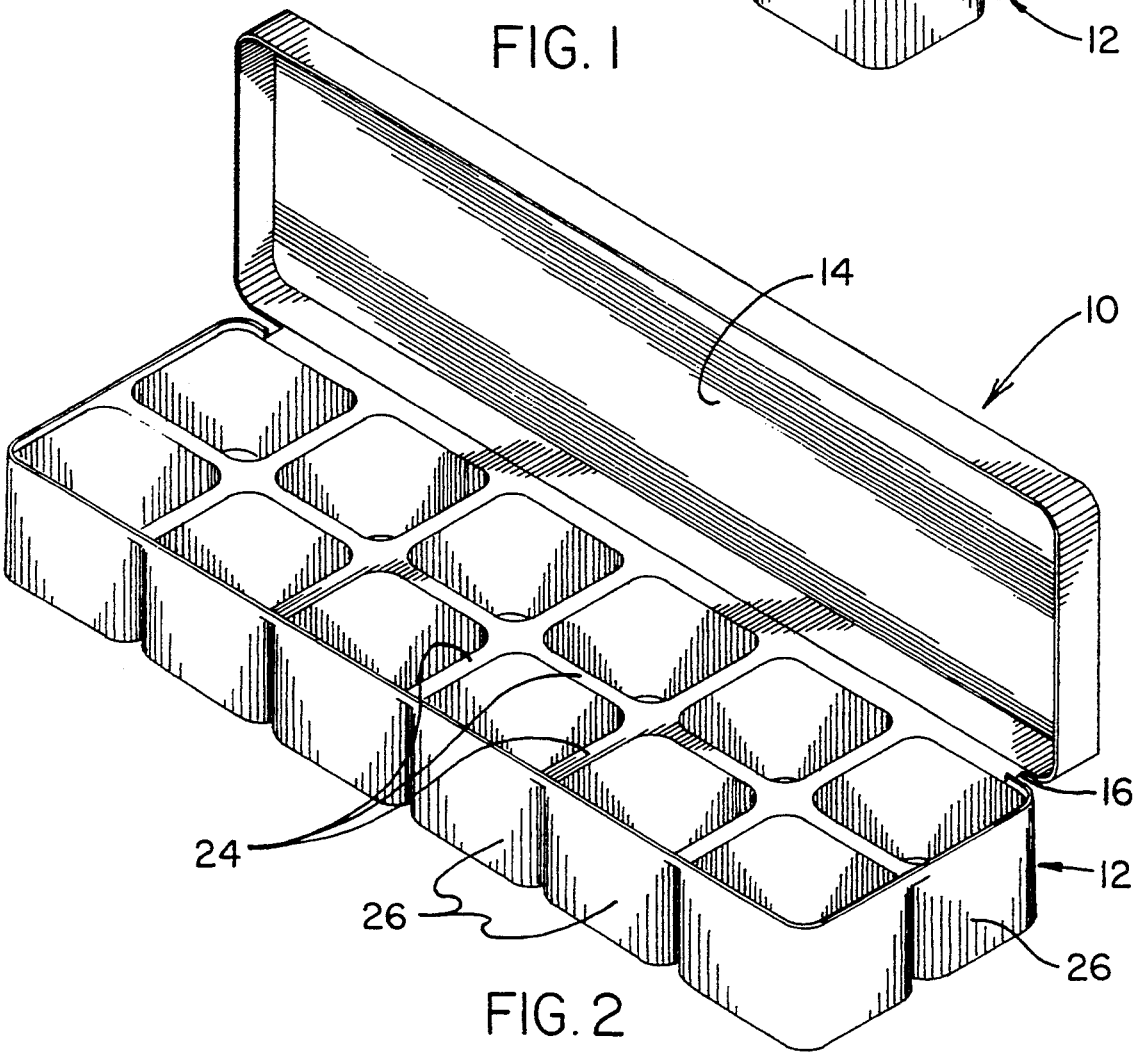
FIG. 2 is a perspective view of the device of FIG. 1 but with the lid raised for loading water or dispensing ice cubes from the device.
Figure 3:
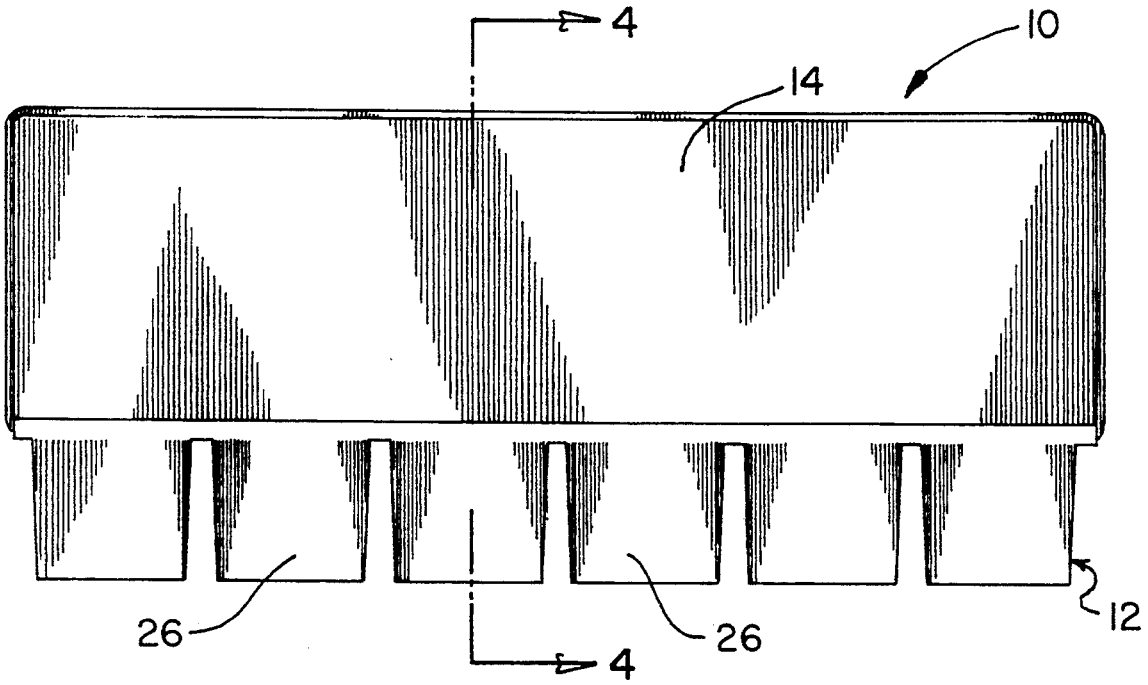
FIG. 3 is a front elevational view of the device of FIGS. 1 and 2 with the lid opened.
Figure 4:
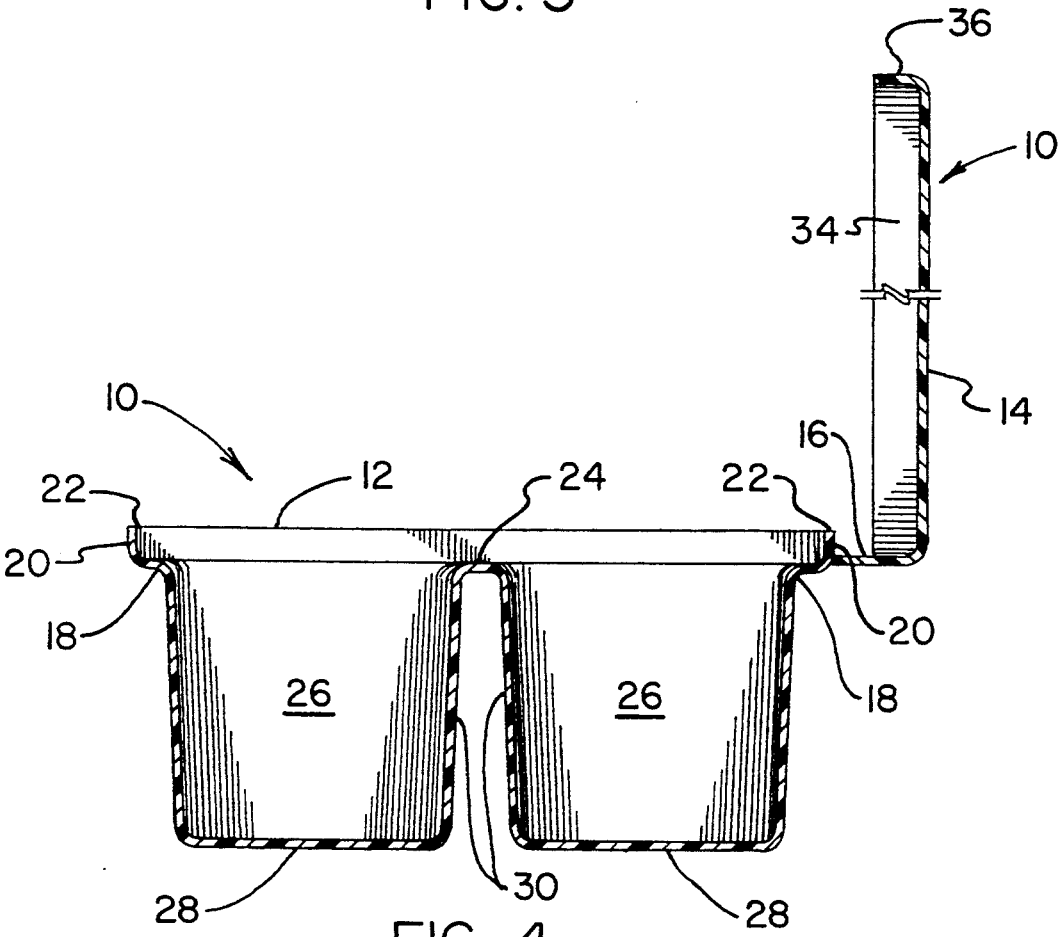
FIG. 4 is a sectional view of the device of the prior Figures taken along line 4—4 of FIG. 3.

With reference now to the drawings, and in particular to FIG. 1 thereof, the preferred embodiment of the new and improved ice cube trays with integral lids embodying the principles and concepts of the present invention and generally designated by the reference numeral 10 will be described.

More specifically, the present invention can be most readily understood by reference to FIGS. 1 through 4. The invention is in a tray assembly 10 for receiving water and for converting such water to ice cubes by freezing. The tray assembly comprises three major components, the tray 12, the cover 14 and the hinge 16 therebetween.

The tray component 12 has an upper horizontal peripheral ledge 18 and an upwardly extending vertical periphery 20 terminating in an upper edge 22. A plurality of planar connectors 24 are connected to the upper ledge 18 to form a grid pattern in a plane with the plane of the upper ledge.

A plurality of compartments 26 extend downwardly from the connectors. Each of the compartments has a lower horizontal surface 28 parallel with, but spaced beneath the upper ledge, essentially equal in distance to the distance of the depth of the water to be placed in the tray and the resulting ice cubes. Each of the compartments 26 also includes a plurality of generally vertically extending side walls 30. The compartments are thus formed with a rectangular configuration extending between the upper edge and the lower wall.

Next provided is the cover 14. The cover 14 has an upper planar surface 34 and downwardly depending peripheral sidewalls 36. The side walls are in a rectangular configuration. The rectangular configuration generally corresponds to the rectangular configuration of the upper edge but is slightly larger to accommodate the closing of the lid with its peripheral side walls in surrounding contact with the periphery of the tray 12. The interior face of the side walls 36 of the lid are thus in facing contact with the interior face 20 of the periphery of the tray. A secure coupling is thus created therebetween.

Lastly, a hinge 16 is provided for coupling the tray adjacent to one elongated edge where the ledge 18 and periphery 20 join with an elongated side wall of the cover 14 as an extension of the side wall. The cover is pivotable between a load/unload orientation where the cover is lifted from the tray and pivoted to a generally vertical orientation perpendicular to the upper edge of the tray and an operative freezing orientation wherein the lower edge of the sidewalls of the cover are in facing contact with the exterior face of the periphery of the tray.

In the preferred embodiment, the compartments of the tray are in rows and columns. All of the compartments are similarly shaped rectangles. Such rectangles are in two rows and 6 columns. Note FIG. 2.

Figure 5:
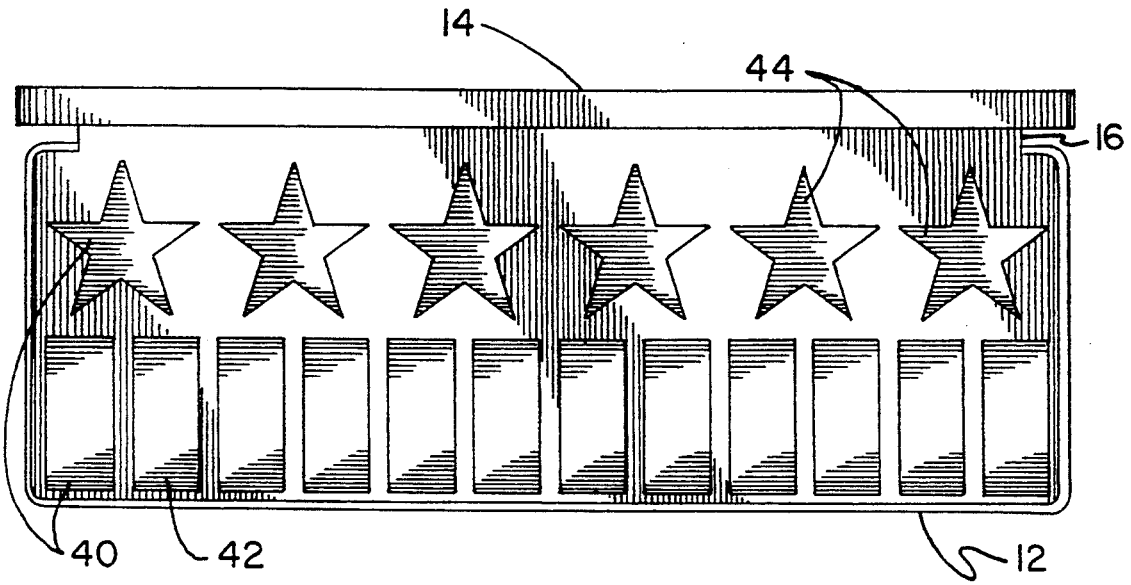
FIG. 5 is an ice cube tray assembly with a tray and lid and an integral lid formed therewith similar to that of the prior Figures but constructed in accordance with an alternate embodiment of the inventions.
Figure 6:
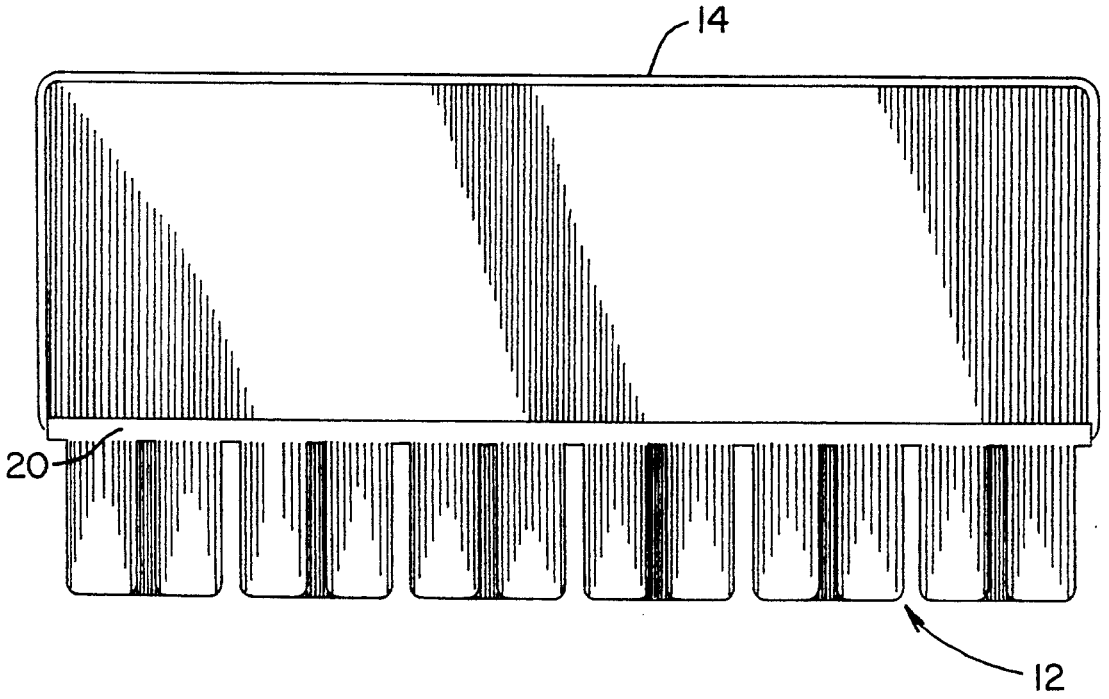
FIG. 6 is a front elevational view of the device of FIG. 5 with the lid opened.

An alternate embodiment of the invention is shown in FIGS. 5 and 6. In such embodiment, the compartments of the tray are also in two rows. One row, however, has its compartments 40 in the shape of the more conventional rectangles 42. The other row is in the shape of five-pointed stars 44. Twelve rectangular compartments are in one row. Six star-shaped compartments are in the other row.

Figure 7:
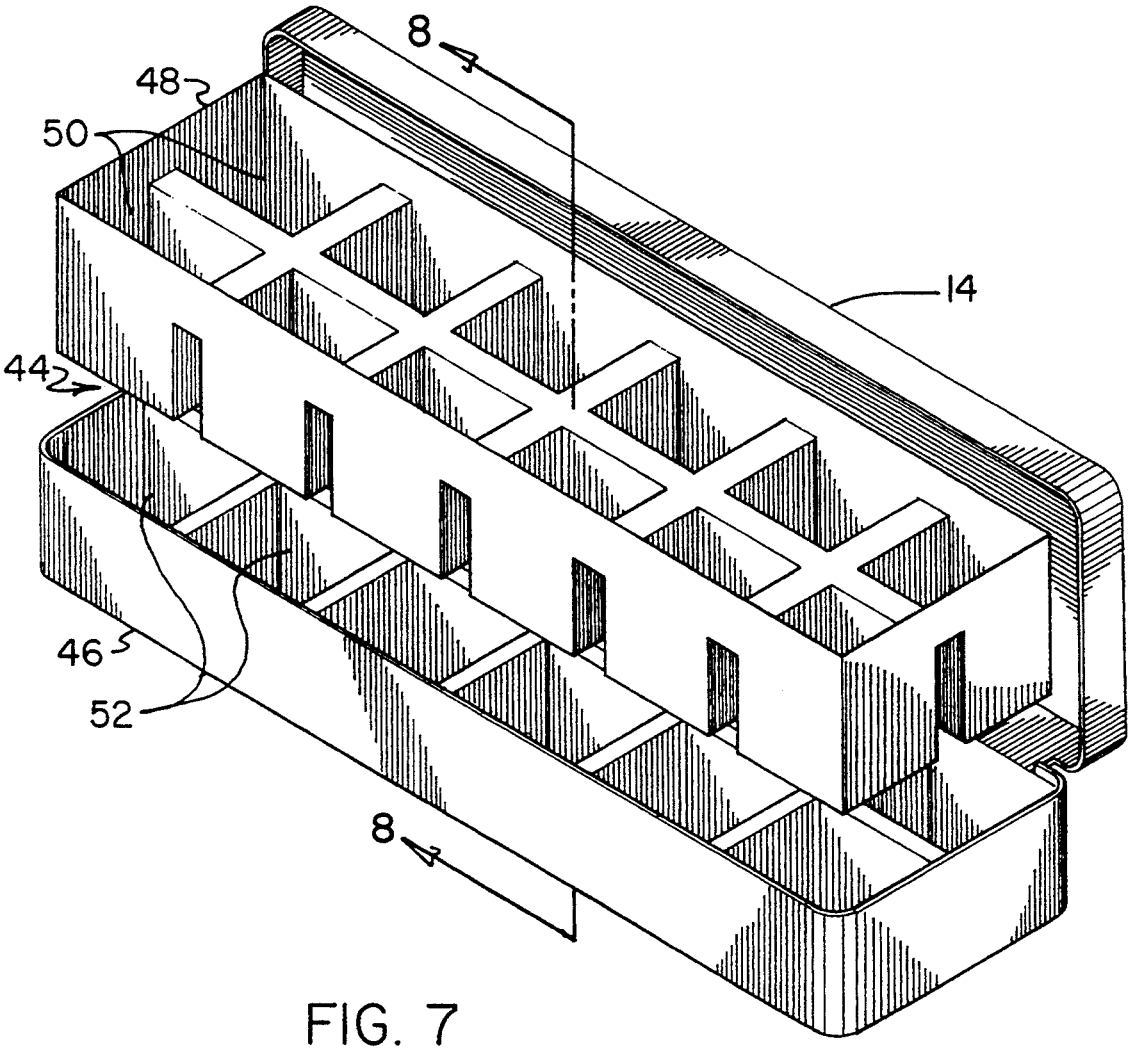
FIG. 7 is an exploded perspective view of an ice cube tray with an integral lid formed in accordance with another alternate embodiment of the invention.
Figure 8:
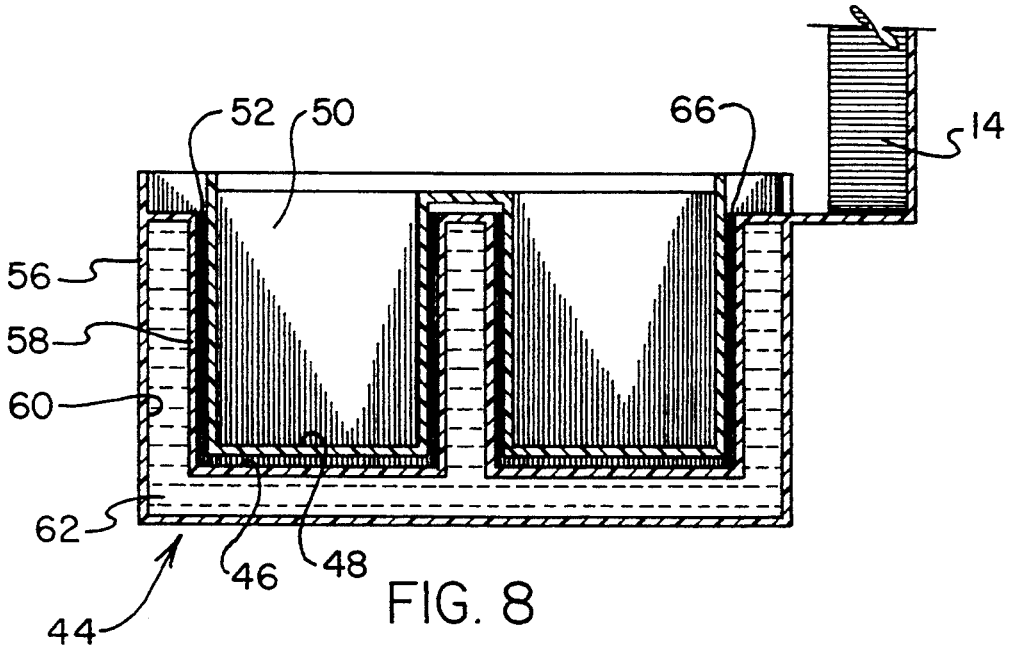
FIG. 8 is a sectional view of the device of FIG. 7 taken along line 8—8 of FIG. 7 with the lid opened and the insert tray in place.

Another alternate embodiment is shown in FIGS. 7 and 8. In such embodiment, the tray 44 includes a primary major tray 46 and a supplemental minor tray 48. Such minor tray 48 includes supplemental minor compartments 50 removably positioned within primary compartments 52 of the primary tray 46. The supplemental tray 46, therefore, has smaller compartments for receiving the water to be frozen. The primary tray 46 includes an outer wall 56, an inner wall 58, and an enclosed chamber 60 with a freezing gel 62 contained therein. Formed between the primary and minor compartments is an insulating space 66. This is all to facilitate ice cube freezing and for allowing the trays with ice cubes to be transported to a remote site such as a picnic whereat the ice will stay frozen for a longer period.

The present invention has numerous advantages over standard trays which are uncovered. To release the cubes, the tray is given a flip-over twist, without concern that the cubes will fly around the room. It can be done firmly, ensuring that all of the cubes are released, but retained in the tray by the cover. There is also no water spillage in carrying the tray from the sink to the refrigerator freezer unit. No foreign matter ever enters the cubes, and freezer odors are never present, thanks to the cover.

The present invention has a lid which snaps shut, but opens easily. It can be made in two sizes, holding 6 cubes and 12 cubes. All trays are stackable, and nest together to form a neat column. The present invention is made in one piece. The lid and dividers are integral to the tray, so they are never separated. No time is ever wasted in looking for one or the other, or both.

The present invention is made of pliable plastic which can withstand the flexing and twisting which are applied to release the cubes, even under the ice cold conditions. Of course, the trays can be offered in a wide choice of colors. In addition to the usual cubical form, the trays can also be designed to make other shapes, including cylinders, tubes, spheres, and the like. It would appear that this is the time for a change in how ice cubes are made. All of the improvements available in this invention are well directed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A device for receiving water and converting it to ice cubes comprising:

a tray fabricated of a plurality of similarly shaped compartments, each compartment having a rectangular base in a common horizontal lower plane with peripheral edges and four vertical side walls extending upwardly from the peripheral edges of the base to form a generally box-like container for the receipt of water, each of the compartments having a peripheral upper edge in a common horizontal upper plane, the compartments being formed in two rows and six columns;

a planar coupling member in the horizontal upper plane formed in a grid-like pattern coupling the upper edges of the compartments in spaced relationship with respect to each other, the coupling member having a generally horizontal peripheral ledge extending outwardly from the coupled compartments with vertically extending peripheral front, rear and side walls extending upwardly therefrom and terminating in an uppermost edge;

a cover having an upper planar surface in a rectangular configuration with long parallel front and rear edges and short parallel side edges, the cover having downwardly extending peripheral walls including long parallel front and rear walls extending downwardly from the front and rear edges and short parallel side walls extending downwardly from the side edges, the walls of the cover being of a size and shape to slidingly fit over the front, rear and side walls of the coupling member and positionable between an open position wherein the cover is in a generally vertical orientation perpendicular to the coupling member and a closed position wherein the walls of the cover encompass and are in contact with the vertically extending walls of the coupling member, the front and side walls of the cover extending downwardly a common first distance with the rear wall extending downwardly a second distance, the second distance being greater than the first distance; and a rectangular hinge formed with an upper edge as an extension of the rear wall of the cover for coupling the cover and the compartments through the coupling member, the hinge also having a lower edge formed integrally with the coupling member at the rear wall of the coupling member adjacent to the horizontal peripheral ledge beneath the uppermost edge.

* * * * *